United States Patent [19]

Weiland

[11] 4,152,273

[45] May 1, 1979

[54] SOIL RELEASABLE HYDROPHILIC SURFACE FINISH FOR TEXTILE FABRICS

[75] Inventor: Herman G. Weiland, Westfield, N.J.

[73] Assignee: Arkansas Co., Inc., Newark, N.J.

[21] Appl. No.: 925,742

[22] Filed: Jul. 18, 1978

[51] Int. Cl.[2] ..... D06M 13/34

[52] U.S. Cl. ..... 252/8.8; 8/115.6; 106/287.16; 560/26

[58] Field of Search ..... 252/8.8; 8/115.6; 106/287.16, 287.34; 560/26

[56] References Cited

U.S. PATENT DOCUMENTS

| | | | |
|---|---|---|---|
| 3,221,305 | 9/1966 | Allen et al. | 106/287.16 |
| 3,544,498 | 12/1970 | Holdstock et al. | 106/287.16 |
| 3,738,981 | 6/1973 | Graff et al. | 560/26 |
| 4,049,873 | 9/1977 | Creasey et al. | 106/287.16 |
| 4,070,152 | 1/1978 | Pentz | 252/8.8 |
| 4,094,925 | 6/1978 | Fellinek et al. | 560/26 |

*Primary Examiner*—William E. Schulz

*Attorney, Agent, or Firm*—Morgan, Finnegan, Pine, Foley & Lee

[57] ABSTRACT

There are provided aqueous, heat curable compositions useful in the finishing of textile fabrics, the compositions comprising a diisophorone alkylene urea ethoxylate, a silanol end-stopped diorganopolysiloxane and a diorganopolysiloxane having an amino functionality. In preferred embodiments, the compositions also comprise a compound selected from among dimethylol dihydroxyethylene urea and dimethylol methoxy ethyl carbamate. The compositions, when applied to textile fabrics, result in improved wettability and soil releasability, without losses in hand modification and resistance to abrasion. Processes and articles are also provided.

26 Claims, No Drawings

SOIL RELEASABLE HYDROPHILIC SURFACE FINISH FOR TEXTILE FABRICS

This invention relates to compositions, processes and articles useful in the durable press finishing of textile fabrics, and especially textile fabrics comprised of cotton fibers or blends of cotton and polyester fibers. Textile fabrics which have been treated conventionally to impart a durable press finish are normally rendered hydrophobic, i.e., they are wetted only with great difficulty, and as a result, they tend to retain absorbed soils and dirt. According to this invention, textile fabrics are provided with a finish which is substantially hydrophilic, having improved soil releasing properties in comparison with conventional silicone and polyethylene fabric finishes, such that the fabric readily absorbs water and readily releases soils and dirt. Moreover, the resulting finished composition retains the properties which are common to fabrics treated with organosilicones. Among other things, it maintains soft hand, good tear strength and resistance to abrasion so that the fibers remain substantially intact during mechanical handling.

BACKGROUND OF THE INVENTION

The use of silicones in the treatment of textile fabrics is well known. Historically, silicones have been employed with thermosetting resins to improve tear strength, abrasion resistance and hand modification of the resins. Silicones have also been used to provide a hydrophobic finish, such as, for instance, in the rainwear industry and other applications where a substantially water-repellant textile surface is desired. Silicones are unique in that relatively small amounts can be used effectively to modify textile surfaces to improve lubricity, to minimize friction and to lower the surface tension.

Typically, an emulsion of a low molecular weight organopolysiloxane in water is prepared and applied to a textile fabric, usually by means of an applicator device comprised of an immersion bath and squeeze rolls. The treated fabric is then dried, and the finish is cured by exposure at an elevated temperature, e.g., in the range from 280° to 350° F. At these elevated temperatures, the organopolysiloxane undergoes polymerization to a higher molecular weight. It is the higher molecular weight polymeric material which provides the desired physical properties for the finish.

It is an object of this invention to provide a hydrophilic surface finish for textile fabrics, with retention of the desirable physical properties of prior art finishes for textile fabrics, e.g., good hand modification, tear strength and resistance to abrasion.

It is another object of this invention to provide a surface finish for textile fabrics which readily absorbs water and readily releases soil particles.

It is another object of this invention to provide a surface finish for textile fabrics which is resistant to the redeposition of released particulate soils.

It is another object of this invention to provide textile fabrics comprised of a surface finish which is substantially hydrophilic and substantially soil releasable.

It is another object of this invention to provide a process for the treatment of textile fabrics to impart a surface finish which is hydrophilic and readily soil releasable.

These objects are realized by this invention.

DESCRIPTION OF THE INVENTION

According to this invention, in one aspect there are provided aqueous heat curable compositions comprising:

(a) a diisophorone alkylene urea ethoxylate having the formula

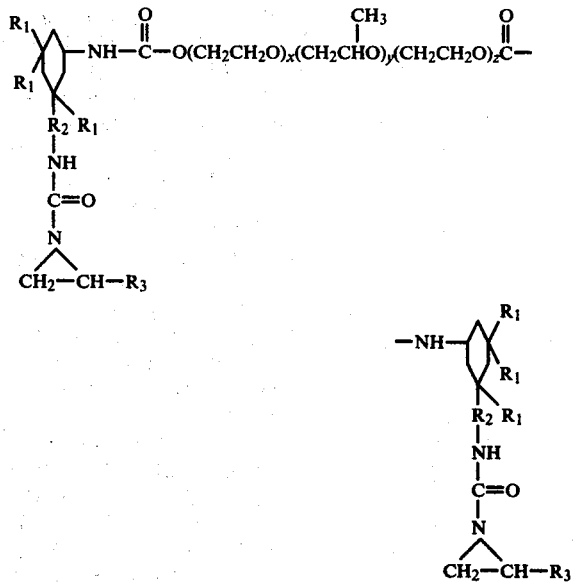

where $R_1$ and $R_2$ are, independently, straight or branched lower alkyl having from 1 to about 6 carbon atoms, e.g., methyl, ethyl, propyl, isopropyl, n-butyl, isobutyl, pentyl, isopentyl, hexyl, and the like; $R_3$ is methyl or ethyl, and x, y and z are, independently, integers of from 10 to about 100, (b) an amino-functional diorganopolysiloxane having the formula

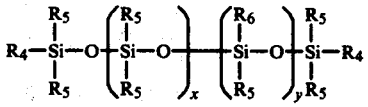

where $R_4$ and $R_5$ are, independently, straight or branched lower alkyl having from 1 to about 10 carbon atoms, $R_6$ is amino, and preferably diamino, and x and y are, independently, integers of from 1 to 10; and (c) a silanol end-stopped diorganopolysiloxane having the formula

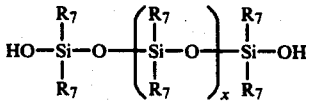

where $R_7$ is straight or branched lower alkyl having from 1 to about 4 carbon atoms, and x is an integer of from 10 to about 100.

In preferred embodiments, the amino-functional diorganopolysiloxane comprises a polydimethylsiloxane wherein the amino-substituent is a diethylene diamine having the formula

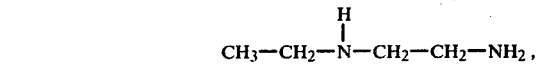

and the viscosity of the polymer is in the range of from 100 to about 1,000 cs., at 25° C.

Preferably, the diisophorone alkylene urea ethoxylate contains a backbone polymer comprised of from about 70 to about 90% by weight of poly(oxyethylene), and from about 10 to about 30% by weight of poly(oxypropylene). In general, the diisophorone propylene urea ethoxylate has a molecular weight in the range of from about 900 to about 4,000, and preferably from about 1,500 to about 2,000. The diisophorone propylene urea ethoxylate is completely soluble in water.

The above ingredients in combination, when cured, provide a durable hydrophilic finish on textile fabrics. The compositions of this invention can be used alone, or together with other thermosetting resins.

The highly polar nature of the amino-functional diorganopolysiloxane, due to the presence of the amino group(s), and the ability of the overall composition to cure, result in a finish which adheres strongly to textile surfaces. Other properties of the composition after curing include improved resilience and reduced friction, pilling and fuzzing, especially in the case of cotton and cotton-polyester knitted textile fabrics. The compositions also impart a very soft hand to the fabrics, either when used independently or together with other thermosetting resins.

The diisophorone alkylene urea ethoxylate is prepared as follows:

An ethoxylate comprised of poly(oxethylene) and poly(oxypropylene) is melted and heated to a temperature of from about 125° to about 135° C., preferably about 130° C., for a period of from about 10 to about 20 minutes, and the melted ethoxylate is then allowed to cool to 90° C. Isophorone diisocyanate is then added and permitted to react with the ethoxylate. While the reaction proceeds, the free isocyanate is determined at regular intervals, e.g., about every 10 minutes, using standard analytical techniques. After one-half of the diisocyanate is reacted, the reaction mixture is rapidly cooled to 35° C. At this point, the remaining free diisocyanate should be about 1% by weight. A sufficient amount of isopropanol is then added as a solvent to keep the reaction product in liquid form, and propylene imine is then added in an amount at least sufficient to react with the remaining free diisocyanate. After the reaction is completed, water is added in a sufficient quantity to produce a viscous, translucent liquid which is miscible with cold water and has a solids content of from about 30 to about 35%, preferably about 33%. The diisophorone propylene urea ethoxylate is thus obtained.

The diorganopolysiloxanes can be prepared by reacting the hydrolyzable diorganosiloxane with a controlled amount of water, in the presence of a suitable acid or base catalyst, to tailor the viscosity of the polymer to the desired range. The diorganopolysiloxane can also be made by conventional equilibration procedures, i.e., by heating a cyclic diorganopolysiloxane for example, a cyclic polysiloxane containing from 3 to 8 chemically combined diorganosiloxy units, such as dimethylsiloxy units, methylphenylsiloxy units, or methyvinylsiloxy units, in the presence of a basic catalyst such as potassium hydroxide. In those cases where the amino-functional diorganopolysiloxane is to be prepared, the cyclic polysiloxane contains an amino group.

In order to obtain the silanol-terminated diorganopolysiloxane, water is added to a diorganopolysiloxane prepared as described above, and the mixture is heated to an elevated temperature, e.g., from 100° to 200° C., for about 10 hours or less. The mixture can then be decatalyzed and stripped to the desired viscosity.

PREPARATION OF THE COMPOSITION

The diisophorone propylene urea ethoxylate, prepared as described above, is then added to a mixture of the silanol end-stopped polyorganosiloxane and the amino-functional diorganopolysiloxane. Preferably, the mixture also contains a nonionic or anionic ethoxylate. The mixture is stirred vigorously, with a mechanical agitator so as to produce a vortex, and water is added slowly in the amount of 70% by weight of the total mixture. Mixing is continued for about 20 minutes, after which the resulting product is passed through a Manton-Gaulin two-stage homogenizer. The setting on the first stage is preferably 1000 pounds per square inch, and the setting on the second stage is preferably about 2000 pounds per square inch, so that the total pressure on the system is about 3000 pounds per square inch. The temperature of the homogenizer is never allowed to rise above 30° C. The resulting product is a milky emulsion comprising about 25% by weight of diorganopolysiloxanes and about 8% by weight of diisophorone propylene urea ethoxylate.

The amounts for each of the ingredients are not critical—they are combinable in virtually all proportions. Preferably, the compositions comprise from about 20 to about 30 parts by weight of the diisophorone alkylene urea ethoxylate, from about 5 to about 10 parts by weight of the amino-functional diorganopolysiloxane and from about 60 to about 70 parts by weight of the silanol end-stopped diorganopolysiloxane.

Other ingredients can also be employed for their conventional purposes. As curing catalysts, for instance, those commonly employed for the curing of N-methylol compounds can be used in the compositions of this invention, including but not limited to zinc nitrate, magnesium chloride, zinc chloride and mixtures of any or all of the foregoing with citric acid.

Illustratively, the composition according to this invention is applied to a textile fabric together with dimethylol dihydroxyethylene urea or dimethylol methoxy ethyl carbamate as follows:

(a) 2% by weight of the composition according to the invention;

(b) 6% by weight of either of the dimethylol dihydroxy ethylene urea or the dimethylol methoxy ethyl carbamate;

(c) 3% by weight of magnesium chloride hexahydrate; and (d) 89% by weight of water.

The textile fabric is preferably impregnated to the extent of from about 50 to about 100%, especially preferably about 75%, wet pick-up. After the fabric has been so treated, it is dried at an elevated temperature, e.g., from about 190° to about 210° F., and the dried finish is cured by heating at an elevated temperature, e.g., from about 300° to about 340° F., for a brief period of time, e.g., about 5–10 minutes.

The treated fabric should contain from about 5 to about 10 parts by weight, on a dry basis, of the cured composition according to this invention.

By way of illustration, after treatment and curing with formulations containing a composition according to this invention, a textile fabric possesses the following properties with respect to wetting, shrinkage resistance and tear strength, in comparison with formulations containing a conventional fabric finish composition.

| REWETTING | | | | | | |
|---|---|---|---|---|---|---|
| Ingredients, parts by weight | A | B | C* | D* | E* | F* |
| Composition according to invention | 2.5 | 2.5 | — | — | — | — |
| Dimethylol dihydroxy ethylene urea (50%) | 5 | 5 | 5 | 5 | 10 | 10 |
| $MgCl_2$ | 1.25 | — | 1.25 | — | 2.5 | — |
| Zinc nitrate | — | 1.25 | — | 1.25 | — | 2.5 |
| Polyethylene fabric softener | — | — | 1.5 | 1.5 | 3 | 3 |
| Time, in seconds, for a drop of water to penetrate | | | | | | |
| 50/50 polyster-cotton, no wash | 2 | 30 | 12 | >60 | 7 | >60 |
| 100% cotton, no wash | 1 | 2 | 25 | >60 | 12 | >60 |
| 50/50 polyster-cotton, after 1 washing | 1 | 1 | 15 | 18 | 20 | 35 |
| 100% cotton, after 1 washing | 1 | 1 | 1 | 3 | 4 | 9 |

*comparison experiment

It is shown that the formulations containing the composition according to this invention, after curing, provide a faster wet-out in comparison with a conventional fabric softener comprised of a polyethylene emulsion.

| SHRINKAGE RESISTANCE | | | |
|---|---|---|---|
| Ingredients, parts by weight | G | H* | I* |
| Composition according to invention | 2.5 | — | — |
| Dimethylol dihydroxy ethylene urea (50%) | 12 | 20 | 12 |
| $MgCl_2$ | 2.1 | 3.5 | 2.1 |
| Polyethylene fabric softener | — | 3 | 1.8 |
| Percent shrinkage, 50/50 polyester-cotton after 5 washings | | | |
| Warp | 1.4 | 1.65 | 1.60 |
| Filling | 0.07 | 0.03 | 0.30 |
| Average | 0.74 | 0.84 | 0.95 |

*comparison experiment

As shown, the formulation containing the composition according to this invention, after curing, does not undergo any more shrinkage, on the average, than the conventional fabric softener.

| TEAR STRENGTH | | | | | | |
|---|---|---|---|---|---|---|
| Ingredients parts by weight | J | K | L* | M* | N* | O* |
| Composition according to invention | 2.5 | 2.5 | — | — | — | — |
| Dimethylol dihydroxy ethylene urea (50%) | 5 | 5 | 5 | 5 | 10 | 10 |
| $MgCl_2$ | 1.25 | — | 1.25 | — | 2.5 | — |
| Zinc nitrate | — | 1.25 | — | 1.25 | — | 2.5 |
| Polyethylene fabric softener | — | — | 1.5 | 1.5 | 3 | 3 |
| Tear strength | | | | | | |
| 50/50 polyester-cotton | | | | | | |
| Warp | 54 | 56 | 54 | 56 | 58 | 59 |
| Filling | 39 | 38 | 40 | 38 | 38 | 40 |
| 100% cotton | | | | | | |
| Wrp | 18 | 16 | 18 | 14 | 15 | 13 |
| Filling | 11 | 10 | 11 | 9 | 9 | 7 |

*comparison experiment
All compositions cured at 300° F. for 3 minutes.

As shown, no lossess in tear strength occur when the compositions according to this invention are substituted for a conventional fabric softener.

The compositions according to the invention, when applied to textile fabrics, e.g., double knits and woven cotton and cotton-polyester fabrics, also significantly reduce the wetting time when compared with the most advanced silicone fabric finish in the prior art.

Other benefits are also obtained, including:

1. Durability. Because compositions according to this invention are reactive with cellulose, they provide a highly durable finish when applied to cellulose-containing textile fabrics such as 100% cotton, and blends of cotton with other fibers such as polyester fibers.

2. Compatibility With Other Resins. The compositions according to this invention are compatible with resins commonly employed to impart a durable press finish to a textile fabric surface, and do not interfere with their effect.

The wrinkle recovery, appearance rating and shrinkage on 50/50 polyester-cotton fabrics remain substantially unchanged after treatment in accordance with this invention. It is noteworthy that the compositions of this invention are at least as effective as conventional organic fabric softeners, such as polyethylene, which are commonly employed in the prior art to improve tear strength, abrasion resistance and sewability. In addition, the compositions of this invention are more effective then conventional fabric softeners in reducing the dusting tendency of cotton fibers.

A further benefit is exceptional soil release. For instance, cotton and cotton-polyester textile fabrics treated in accordance with this invention, when stained with vegetable oil, motor oil or No. 6 Bunker fuel, after 1–5 launderings often exhibit a 50% improvement in stain release properties in comparison with the silicone finishes of the prior art.

In addition to the foregoing compositions and processes of textile fabric treatment, this invention also contemplates textile fabrics comprised wholly or at least in part of cellulose fibers, e.g., cotton, which have been treated with the compositions of the invention.

DESCRIPTION OF THE PREFERRED EMBODIMENTS

The compositions, processes and articles of this invention are further illustrated in the following examples. These are not intended to be limiting.

EXAMPLE

A composition according to this invention is prepared as follows:

Two-hundred thirty-four grams of Pluronic F-68, an ethoxylate comprised of 80% by weight of poly(oxyethylene) and 20% poly(oxypropylene) commercially available from Wyandotte Chemical Co., or equivalent, is introduced into a dry reaction vessel, melted and heated to 130° C. The source of heat is then removed and the ethoxylate melt is cooled to 90° C.

Fourteen grams of isophorone diisocyanate is added slowly with agitation. The agitation is continued for about 15 minutes, after which 4/100 gram of dibutyl tin dilaurate is added, with no further heating. At this point, the reaction mixture is analyzed to determine the amount of free isocyanate. The isocyanate content should be 1% or less, before proceeding any further.

The following substances are then added to the reaction mixture:

(i) Ninety-four grams of isopropyl alcohol, previously cooled to about 40° C.;

(ii) One-half gram of 2-dimethyl amino-2-methyl-1-propanol (DMAMP);

(iii) Four grams of propylene imine;

(iv) Sixty-eight grams of an ethoxylate alkyl phenol;

(v) Eleven-hundred and thirty-three grams of a dimethyl polysiloxane end-blocked with silanol groups, having a viscosity of 100 cs. at 20° C.;

(vi) Eleven-hundred and thirty-three grams of a dimethyl polysiloxane end-blocked with silanol groups, having a viscosity of 1000 cs. at 25° C.; and (vii) Thirty-five hundred and sixty-four grams of water, added with continuing agitation.

The resulting mixture is homogenized by passing it through a Manton-Gaulin mill, at a total pressure of 3000 pounds per square inch.

Textile fabric blends of polyester and cotton fibers, consisting of between 35 and 80% by weight of cotton, may be treated with the above composition in combination with dimethylol dihydroxyethylene urea, or dimethylol methoxy carbamate. To catalyze the curing of the resin, magnesium chloride hexahydrate is used.

The resulting treated fabrics possess all of the properties common to prior art fabric finishes, such as soft hand, abrasion resistance and improved lubricity, with the additional property of being durably hydrophilic and soil releasant.

Modifications and variations of the invention described above will suggest themselves to those of ordinary skill in the art in the light of the above disclosure. It is to be understood, therefore, that changes may be made in the particular embodiments described herein, without departing from the scope of the invention as defined in the appended claims.

I claim:

1. An aqueous heat curable composition for the treatment of textile fabrics, the composition comprising:

(a) a diisophorone alkylene urea ethoxylate having the formula

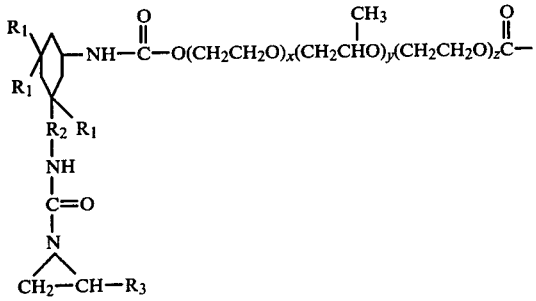

-continued

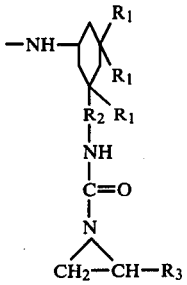

where $R_1$ and $R_2$ are, independently, straight or branched lower alkyl having from 1 to about 6 carbon atoms; $R_3$ is methyl or ethyl, and x, y and z are, independently, integers of from 10 to about 100.

(b) an amino-functional diorganopolysiloxane having the formula

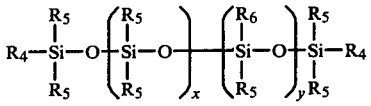

where $R_4$ and $R_5$ are, independently, straight or branched lower alkyl having from 1 to about 10 carbon atoms, $R_6$ is amino and x and y are, independently, integers of from 1 to 10; and (c) a silanol end-stopped diorganopolysiloxane having the formula

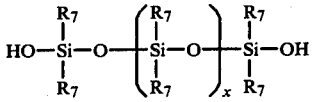

where $R_7$ is straight or branched lower alkyl having from 1 to about 4 carbon atoms, and x is an integer of from 10 to about 100.

2. The composition of claim 1 comprising from about 20 to about 30 parts by weight of the diisophorone alkylene urea ethoxylate, from about 5 to about 10 parts by weight of the amino-functional diorganopolysiloxane, and from about 60 to about 70 parts by weight of the silanol end-stopped diorganopolysiloxane.

3. The composition of claim 1 wherein the diisophorone alkylene urea ethoxylate comprises a backbone polymer comprising from about 70 to 90% by weight of poly(oxyethylene) and from about 10 to about 30% by weight of poly(oxypropylene).

4. The composition of claim 1 wherein the amino-functional group of the amino-functional diorganopolysiloxane is diamino.

5. The composition of claim 4 wherein the diamino is diethylene diamine.

6. The composition of claim 5 wherein the amino-functional diorganopolysiloxane has a viscosity of from 100 to about 1,000 cs. at 25° C.

7. The composition of claim 1 wherein the silanol end-stopped diorganopolysiloxane is a polydimethysiloxane.

8. A process for the treatment of a cellulose containing textile fabric, the process comprising contacting the fabric with a heat curable composition comprising (a) a diisophorone alkylene urea ethoxylate having the formula

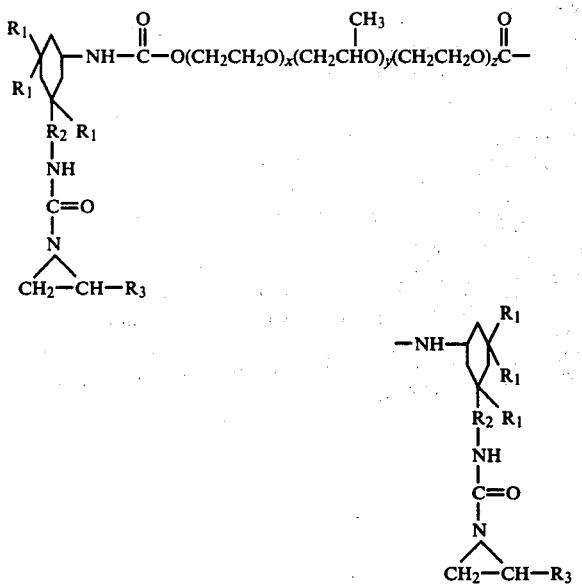

where $R_1$ and $R_2$ are, independently, straight or branched lower alkyl having from 1 to about 6 carbon atoms; $R_3$ is methyl or ethyl, and x, y and z are, independently, integers of from 10 to about 100, (b) an amino-functional diorganopolysiloxane having the formula

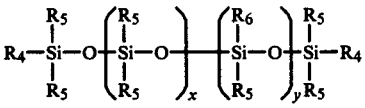

where $R_4$ and $R_5$ are, independently, straight or branched lower alkyl having from 1 to about 10 carbon atoms, $R_6$ is amino and x and y are, independently, integers of from 1 to 10; and (c) a silanol end-stopped diorganopolysiloxane having the formula

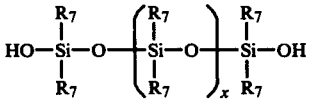

where $R_7$ is straight or branched lower alkyl having from 1 to about 4 carbon atoms, and x is an integer of from 10 to about 100.

9. The process of claim 8 which comprises the further step of (c) heating the treated fabric at an elevated temperature to cure said composition.

10. The process of claim 9 wherein the treated fabric is heated at a temperature in the range of from about 190° to about 210° F.

11. The process of claim 8 wherein the heat curable composition comprises from about 20 to about 30 parts by weight of the diisophorone propylene urea ethoxylate, from about 5 to about 10 parts by weight of the amino-functional diorganopolysiloxane, and from about 60 to about 70 parts by weight of the silanol end-stopped diorganopolysiloxane.

12. The process of claim 8 wherein the diisophorone propylene urea ethoxylate comprises a backbone polymer comprising from about 70 to 90% by weight of poly(oxyethylene) and from about 10 to about 30% by weight of poly(oxypropylene).

13. The process of claim 8 wherein the amino-functional group of the amino-functional diorganopolysiloxane is diamino.

14. The process of claim 13 wherein the diamino is diethylene diamine.

15. The process of claim 14 wherein the amino-functional diorganopolysiloxane has a viscosity of from 100 to about 1,000 cs. at 25° C.

16. The process of claim 8 wherein the silanol end-stopped diorganopolysiloxane is a polydimethysiloxane.

17. A cellulose containing textile fabric which has been treated with a composition comprising (a) a diisophorone propylene urea ethoxylate having the formula

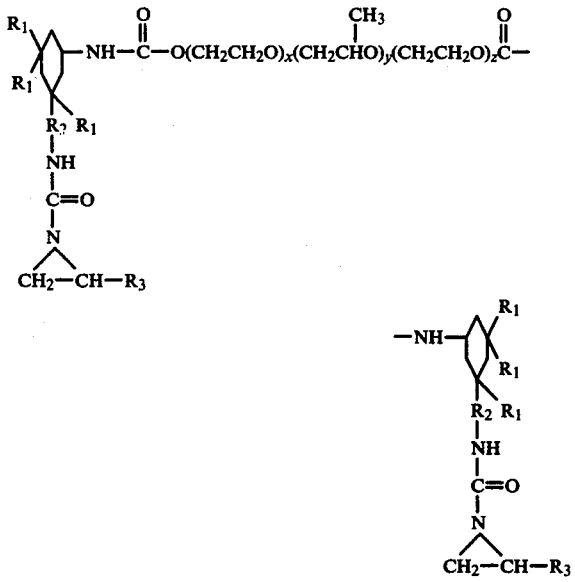

where $R_1$ and $R_2$ are, independently, straight or branched lower alkyl having from 1 to about 6 carbon atoms; $R_3$ is methyl or ethyl, and x, y and z are, independently, integers of from 10 to about 100, (b) an amino-functional diorganopolysiloxane having the formula

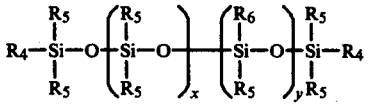

where $R_4$ and $R_5$ are, independently, straight or branched lower alkyl having from 1 to about 10 carbon atoms, $R_6$ is amino and x and y are, independently, integers of from 1 to 10; and (c) a silanol end-stopped diorganopolysiloxane having the formula

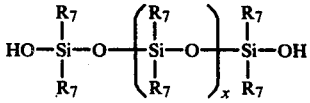

where $R_7$ is straight or branched lower alkyl having from 1 to about 4 carbon atoms, and x is an integer of from 10 to about 100.

18. The textile fabric of claim 17 which comprises cotton fibers.

19. The textile fabric of claim 17 which comprises a blend of cotton and polyester fibers.

20. The textile fabric of claim 17 wherein the composition comprises from about 20 to about 30 parts by weight of the diisophorone propylene urea ethoxylate, from about 5 to about 10 parts by weight of the amino-functional diorganopolysiloxane, and from about 60 to about 70 parts by weight of the silanol end-stopped diorganopolysiloxane.

21. The textile fabric of claim 17 wherein the diisophorone propylene urea ethoxylate comprises a backbone polymer comprising from about 70 to 90% by weight of poly(oxyethylene) and from about 10 to about 30% by weight of poly(oxypropylene).

22. The textile fabric of claim 17 wherein the amino-functional group of the amino-functional diorganopolysiloxane is diamino.

23. The textile fabric of claim 22 wherein the diamino is diethylene diamine.

24. The textile fabric of claim 23 wherein the amino-functional diorganopolysiloxane has a viscosity of from 100 to about 1,000 cs. at 25° C.

25. The textile fabric of claim 17 wherein the silanol end-stopped diroganopolysiloxane is a polydimethylsiloxane.

26. The textile fabric of claim 17 wherein the composition has been heat cured.

* * * * *